US006203400B1

(12) United States Patent
Allen et al.

(10) Patent No.: US 6,203,400 B1
(45) Date of Patent: Mar. 20, 2001

(54) PUSH-IN UNDERWIRE BRA

(75) Inventors: Don Allen, New York, NY (US); Frank Wolfson, Bridgeport, CT (US)

(73) Assignee: Warnaco U.S., Inc., Milford, CT (US)

( * ) Notice: Subject to any disclaimer, the term of this patent is extended or adjusted under 35 U.S.C. 154(b) by 0 days.

(21) Appl. No.: 09/598,118

(22) Filed: Jun. 21, 2000

(51) Int. Cl.[7] ..... A41C 3/00
(52) U.S. Cl. ..... 450/41; 450/1
(58) Field of Search ..... 450/41–53, 1

(56) References Cited

U.S. PATENT DOCUMENTS 2,883,988 * 4/1959 Lee ..... 450/41
5,730,641 * 3/1998 Brown ..... 450/41

* cited by examiner

*Primary Examiner*—Gloria M. Hale

(74) *Attorney, Agent, or Firm*—Amster, Rothstein & Ebenstein

(57) ABSTRACT

A lightweight, substantially unpadded, comfortable, push-in underwire bra has, when worn by a female wearer, a front including a pair of cups. Each cup defines upper inner and outer portions, lower inner and outer portions, a top and a bottom, and is configured and dimensioned to hold substantially one breast of a female wearer. Each cup defines an underwire-receiving channel extending downwardly from the cup upper outer portion and then inwardly across the cup bottom to the cup lower inner portion where the channel terminates. A single underwire-free channel extension connects the channels of the cups only at the lower inner portions thereof, the cups being connected at the front only by the channel extension, thereby to provide a deeply plunging cleavage and enable substantial independent motion of the cups relative to one another. For each cup, a thin, arcuate underwire is disposed in the channel and biases the cup upper outer portion inwardly. Thus, the underwires bias the cup upper outer portions inwardly to provide push-in cleavage on the wearer's breasts. Straps are secured to the front for releasably supporting it on a female wearer with the breasts of the female wearer substantially within the cups.

17 Claims, 6 Drawing Sheets

66
24
51
50
62
40
30
18
22
60
70
32
66
60
51
40
50
62
60
50

PUSH-IN UNDERWIRE BRA

BACKGROUND OF THE INVENTION

The present invention relates to an underwire bra, and more particularly to a lightweight, substantially unpadded, comfortable, push-in underwire bra.

A wide variety of underwire bras is well-known in the bra art. The use of an underwire bra, as opposed to a non-underwire bra, ensures that a hypermammiferous woman will receive adequate breast support. The underwire conforms and clings to the skin of the wearer to preclude "lifting" of the bottom or band of the bra (which passes about the torso of the wearer), thereby ensuring that a bottom portion of the wearer's breast cannot fall between the wearer and the band. The underwire additionally helps to support the breast within the cup, thereby relieving some of the weight which is otherwise by borne by the shoulder straps of the bra and hence the shoulders of the wearer.

Typically, an underwire is generally U-shaped in configuration, although the length of the legs of the U may vary. As the conventional function of the underwire is to push the breast upwardly and thereby provide cleavage between the breasts, the underwire typically extends about the base of the breast with the bight of the U at the bottom of the base, a lateral or an outer leg of the U extending substantially towards the top of the cup, and a medial or inner leg of the U extending at least an appreciable length (and typically a substantial length) towards the top of the cup. As a result, the underwire bra is typically of a "push-up" type which attempts to raise the wearer's breast in a more or less vertical direction. As the underwire bra is typically especially designed for women of substantial breast proportions, it is typically substantially unpadded, although in various instances it may be provided with an either integral or detachable pad adjacent the bottom of the cup in order to assist in the push-up function and thereby achieve additional cleavage.

Regardless of whether the wearer is of slight or substantial breast proportions, the push-up effect is less than satisfactory in practice due to the "double breast" effect. With a push-up bra, each breast appears to be formed of two vertically aligned separate breasts, one which is pushed up within the cup by the padding and one which is a bunching of skin above the top of the bra, such bunching resembling a slight separately formed auxiliary breast. Accordingly, the desired cleavage is achieved by the push-up bra only by somewhat sacrificing the aesthetics.

The cups of the typical underwire bra are connected by a gore, a relatively high small strip of material connecting the bras cups at the bottom of the cups and for some appreciable distance thereabove. While the gore is typically flexible, it still limits independent movement of the cups relative to to one another and thereby decreases the comfort of the bra.

Despite the wide variety of underwire bras in the prior art, the need remains for such a bra which is lightweight, substantially unpadded, comfortable and designed to provide a push-in effect which accentuates cleavage.

Accordingly, it is an object of the present invention to provide a lightweight, substantially unpadded, comfortable, push-in underwire bra which provides deeply plunging cleavage while enabling substantial independent motion of the cups (and hence the wearer's breasts) relative to one another.

SUMMARY OF THE INVENTION

It has now been found that the above and related objects of the present invention are obtained in a lightweight, substantially unpadded, comfortable, push-in underwire bra comprising, when worn by a female wearer, a front and means secured to the front for releasably supporting the front on a female wearer with the breasts of the female wearer substantially within the cups. The front includes a pair of cups. Each cup defines upper inner and outer portions, lower inner and outer portions, a top and a bottom, and is configured and dimensioned to hold substantially one breast of a female wearer. Each cup defines an underwire-receiving channel extending downwardly from the cup upper outer portion and then inwardly across the cup bottom to the cup lower inner portion where the channel terminates. A single underwire-free channel extension connects the channels of the cups only at the lower inner portions thereof, the cups being connected at the front only by the channel extension, thereby to provide a deeply plunging cleavage and enable substantial independent motion of the cups relative to one another. For each cup, a thin, arcuate underwire is disposed in the channel and biases the cup upper outer portion inwardly. Thus, the underwires bias the cup upper outer portions inwardly to provide push-in cleavage on the wearer's breasts. Straps are secured to the front for releasably supporting it on a female wearer with the breasts of the female wearer substantially within the cups.

In a preferred embodiment, the cups are devoid of substantial padding. To the extent that the cups contain padding, the padding is uniformly distributed over substantially the entire surface of the cups. Each cup defines an inner lower length extending from the lower inner portion to at least a midpoint between the upper and lower inner portions. Such inner lower length is substantially linear, and preferably the inner lower lengths of the cups are substantially parallel.

In a preferred embodiment, the channel extends arcuately downwardly and arcuately inwardly, and terminates at the cup lower inner portion without appreciable ascent towards the cup upper inner portion. The channel extension is configured and dimensioned to snugly fit the wearer between and below the breasts, and the bra is characterized by the absence of a gore connecting the inner portions of the pair of cups above the channel extension.

Preferably the underwire has two flat major surfaces configured and dimensioned to lie parallel to the body of the wearer. The underwire extends substantially the entire length of the underwire-receiving channel.

Preferably the supporting means includes a backstrap secured at each end to a respective outer portion of one of the cups and a pair of optional shoulder straps connecting the cup tops to the backstrap.

BRIEF DESCRIPTION OF THE DRAWING

The above and related objects, features, and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
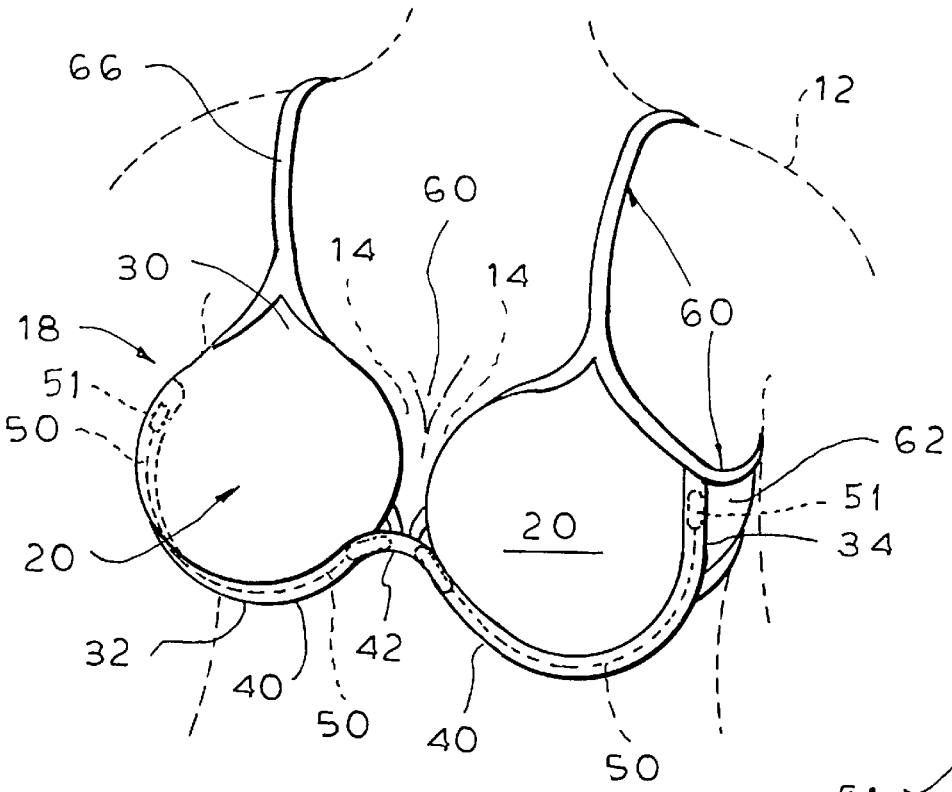
FIG. 1 is an isometric view of a bra according to the present invention, showing the bra on a wearer illustrated in phantom line.

Referring now to the drawing, and in particular to FIG. 1 thereof, therein illustrated is a lightweight, substantially unpadded, comfortable, push-in underwire bra according to the present invention, generally designated by the reference numeral 10.

When worn by a female wearer 12 having breasts 14, the bra 10 comprises a front generally designated 18. As best seen in FIGS. 3–7, the front 18 includes a pair of cups 20, each cup defining upper inner and outer portions 22, 24, lower inner and outer portions 26, 28, a top 30 connecting the upper inner and outer portions 22, 24, and a bottom 32 connecting the lower inner and outer portions 26, 28.

Each cup 20 is configured and dimensioned to hold substantially one breast 14 of a female wearer 12. Preferably the top 30 is somewhat chevron shaped, and the bottom 32 is somewhat convexly curved. The lateral or outer side 34 may be substantially linear or slightly convex and the medial or inner side 36 is preferably substantially linear below the top 30—that is, between the upper inner portion 22 and the lower inner portion 26. Preferably each cup 20 defines an inner lower length 38 extending from the lower inner portion 26 to at least a midpoint between the upper and lower inner portions 22, 26. Preferably the two inner lower lengths 38 are substantially linear and optimally substantially parallel.

The cups 20 are devoid of substantial padding and, to the extent that the cups do contain padding, the padding is uniformly distributed over substantially the entire surface of the cups. More particularly, the cups 20 may be formed of a relatively thin layer of foam material. Soft and smooth liners (one adjacent the breast and one spaced from the breast) may define the major outer surfaces of the cup to provide comfort to the wearer and present an aesthetic quality to a viewer.

Each cup 20 defines an underwire—receiving channel 40 which extends downwardly from the cup upper outer portion 24 to the cup outer lower portion 28, and then inwardly across the cup bottom 32 to the cup lower inner portion 26 where the channel 40 terminates. Thus the channel 40 extends along an outer or lateral side 34 of the cup and across the bottom 32 thereof, but it does not extend appreciably along medial or inner side of the cup between the upper inner portion 22 and the lower inner portion 26. More particularly, the channel 40 preferably extends arcuately downwardly from the upper outer portion 24 to the outer lower portion 28 and then arcuately inwardly from the outer lower portion 28 to the inner lower portion 26.

A single underwire-free channel extension 42 connects the channels 40 of the two cups 20 only at the lower inner portions 26 thereof. The extension 42 underwire-free and preferably of a height (from bottom to top) substantially the same as the channels 40. The channel extension 42 replaces the prior art gore which typically connects the two cups and extends substantially above the bottom inner portions 26 and substantially towards the upper inner portions 22. The channel extension 42 is configured and dimensioned to snugly fit the wearer between and below the breasts 14, and the bra 10 is characterized by the absence of any gore connecting the inner portions 22, 26 of the pair of cups 20 above the channel extension 42. As the cups 20 are connected at the front 18 only by the channel extension 42, a deeply plunging cleavage is provided and substantial independent motion of the two cups 20 relative to one another is made possible. The cleavage is considered aesthetically desirable, and the substantially independent mobility of the cups contributes to the comfort of wearing the bra 10.

Figure 2:
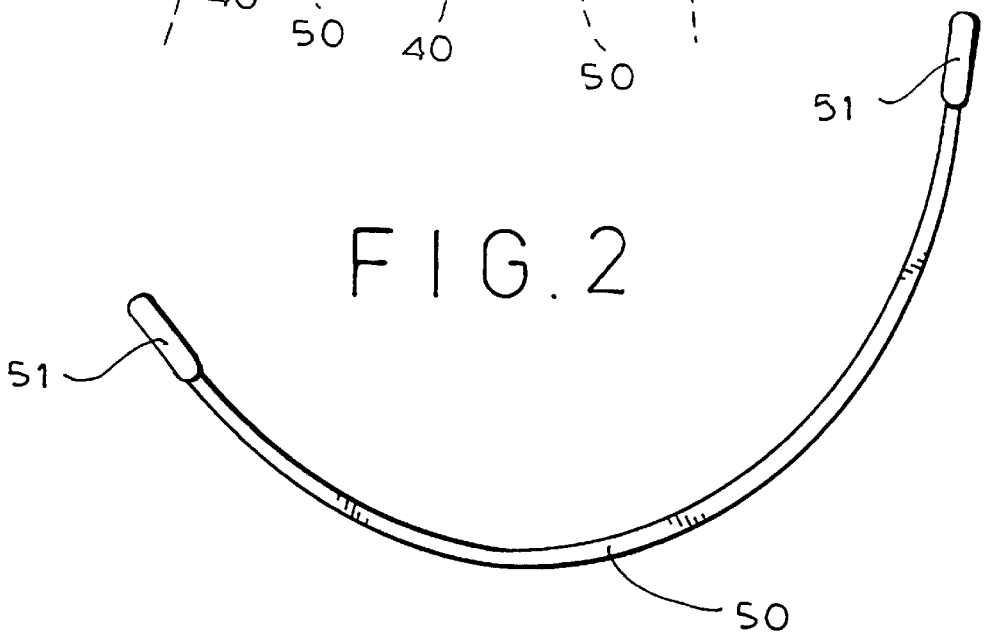
FIG. 2 is a front elevational view of an underwire for use therein.
Figure 3:
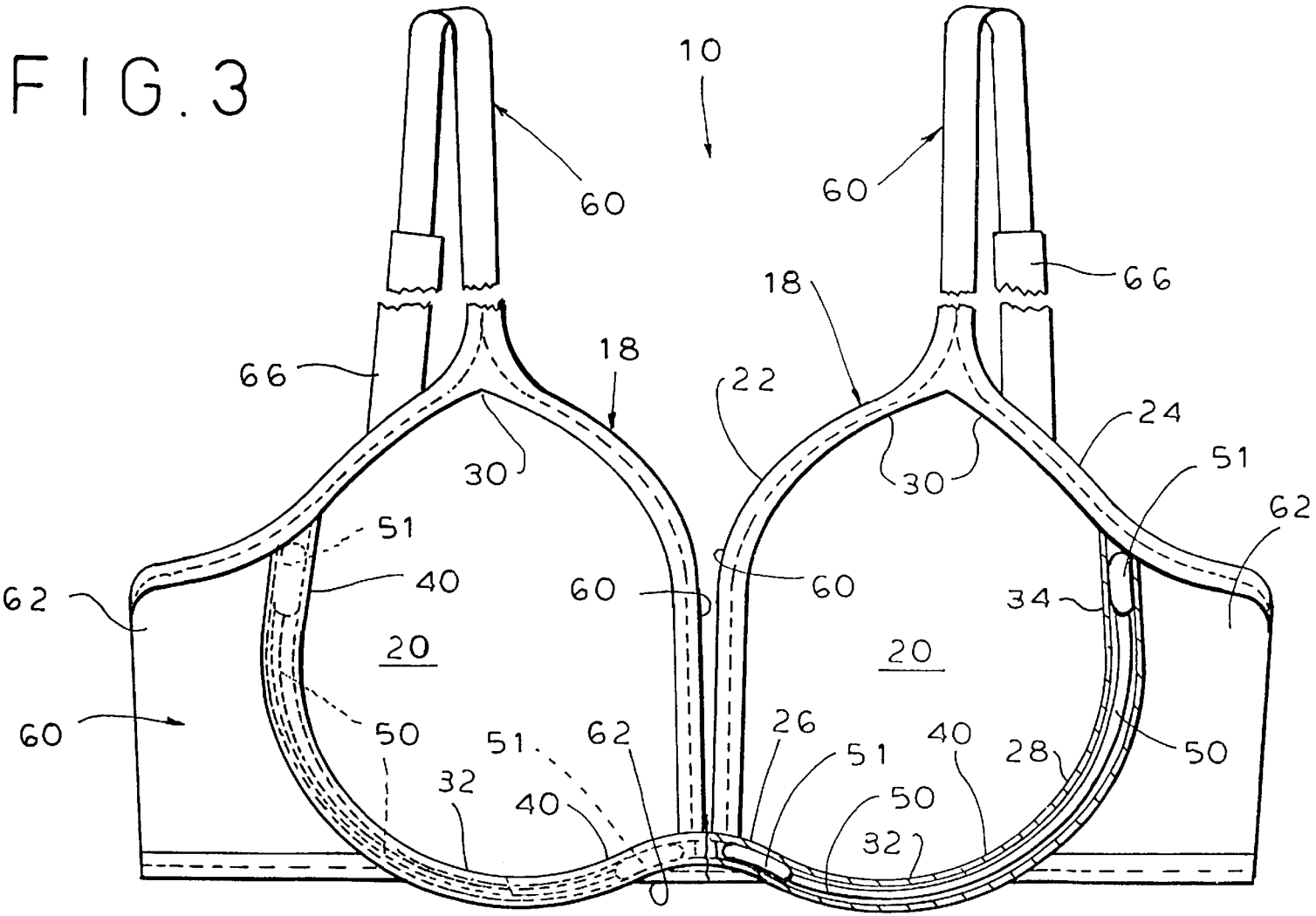
FIG. 3 is a front elevational view of a bra according to the present invention.
Figure 4:
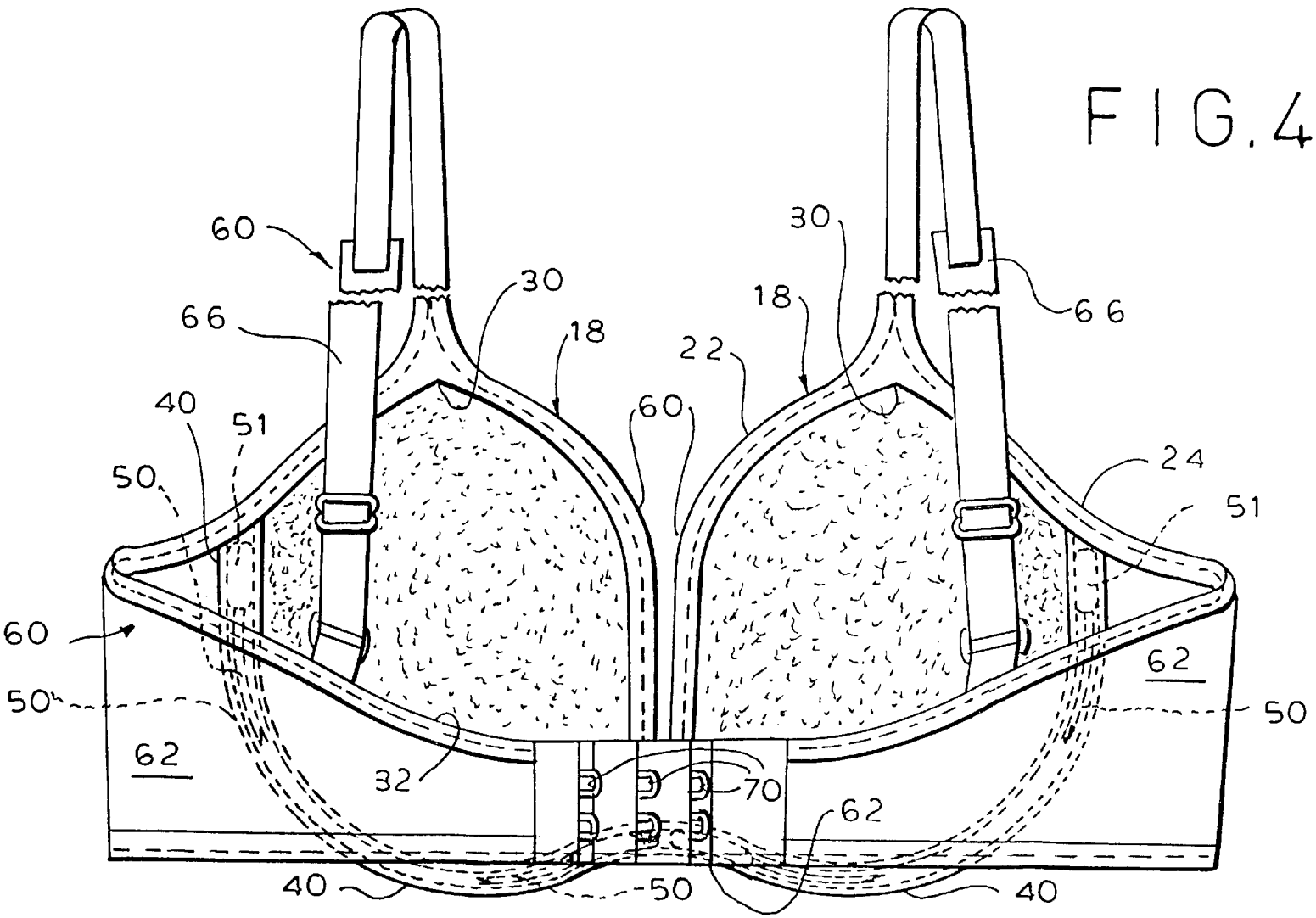
FIG. 4 is a back elevational view thereof.
Figure 5:
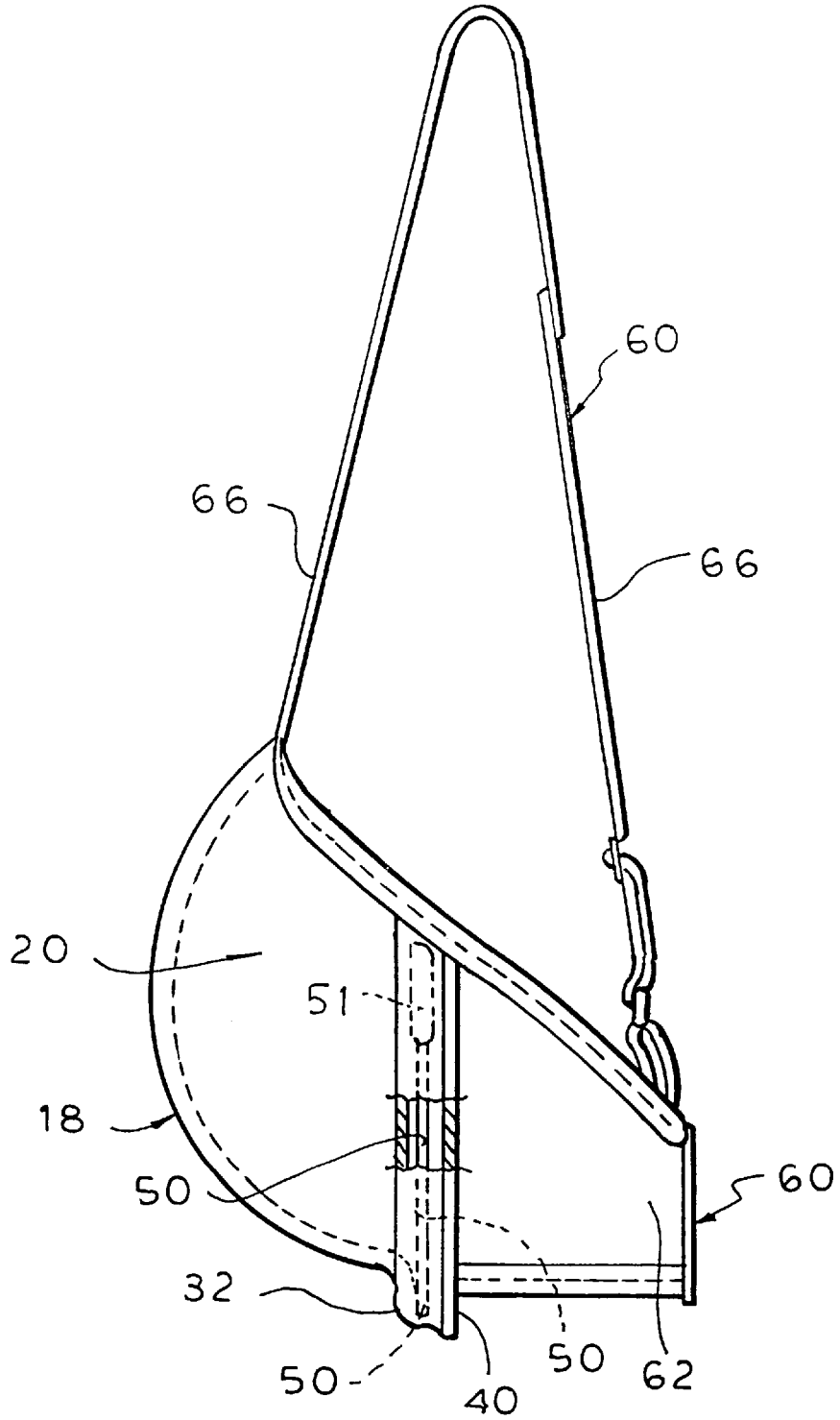
FIG. 5 is a side elevational view thereof.
Figure 6:
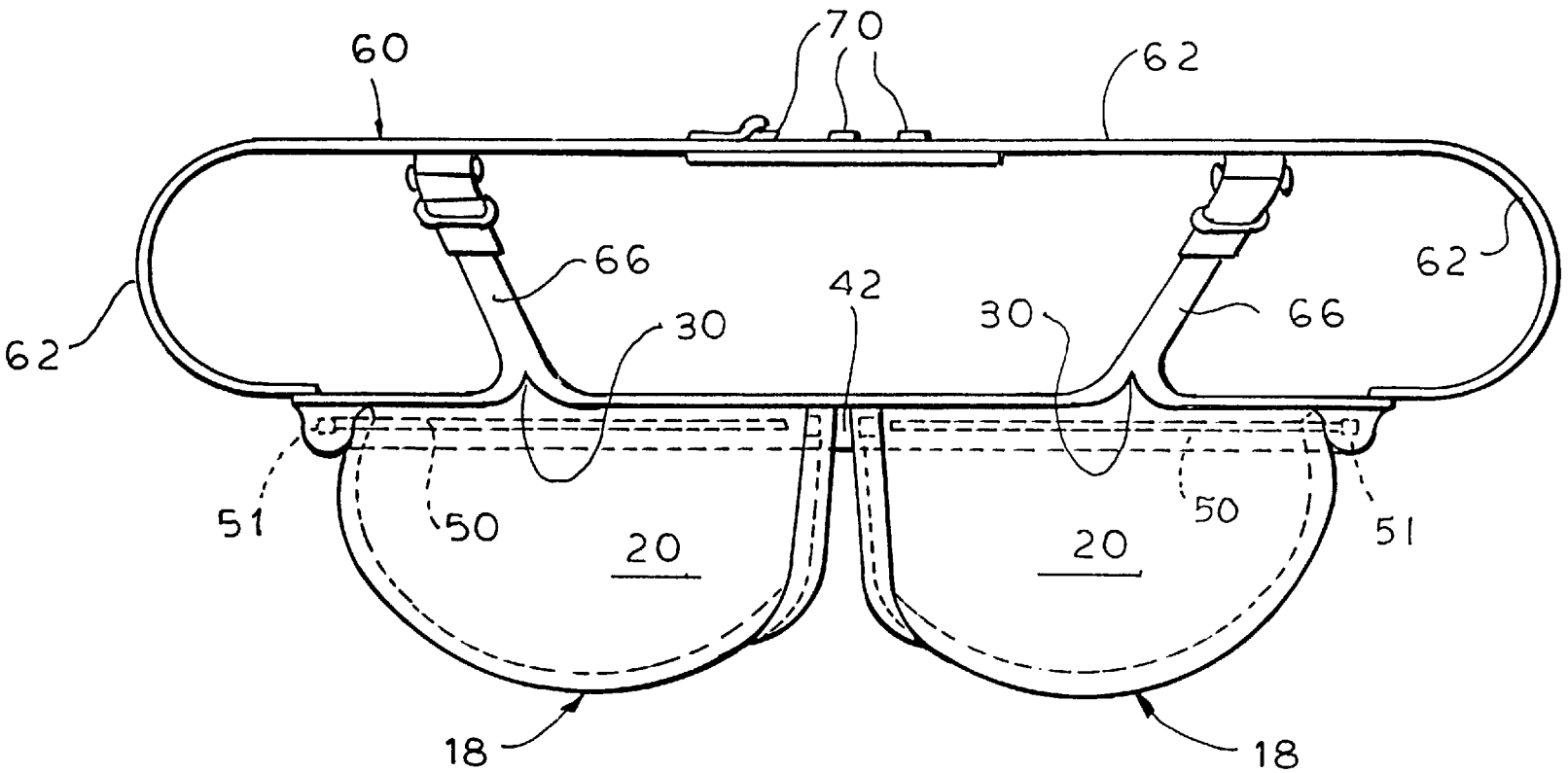
FIG. 6 is a top plan view thereof.
Figure 7:
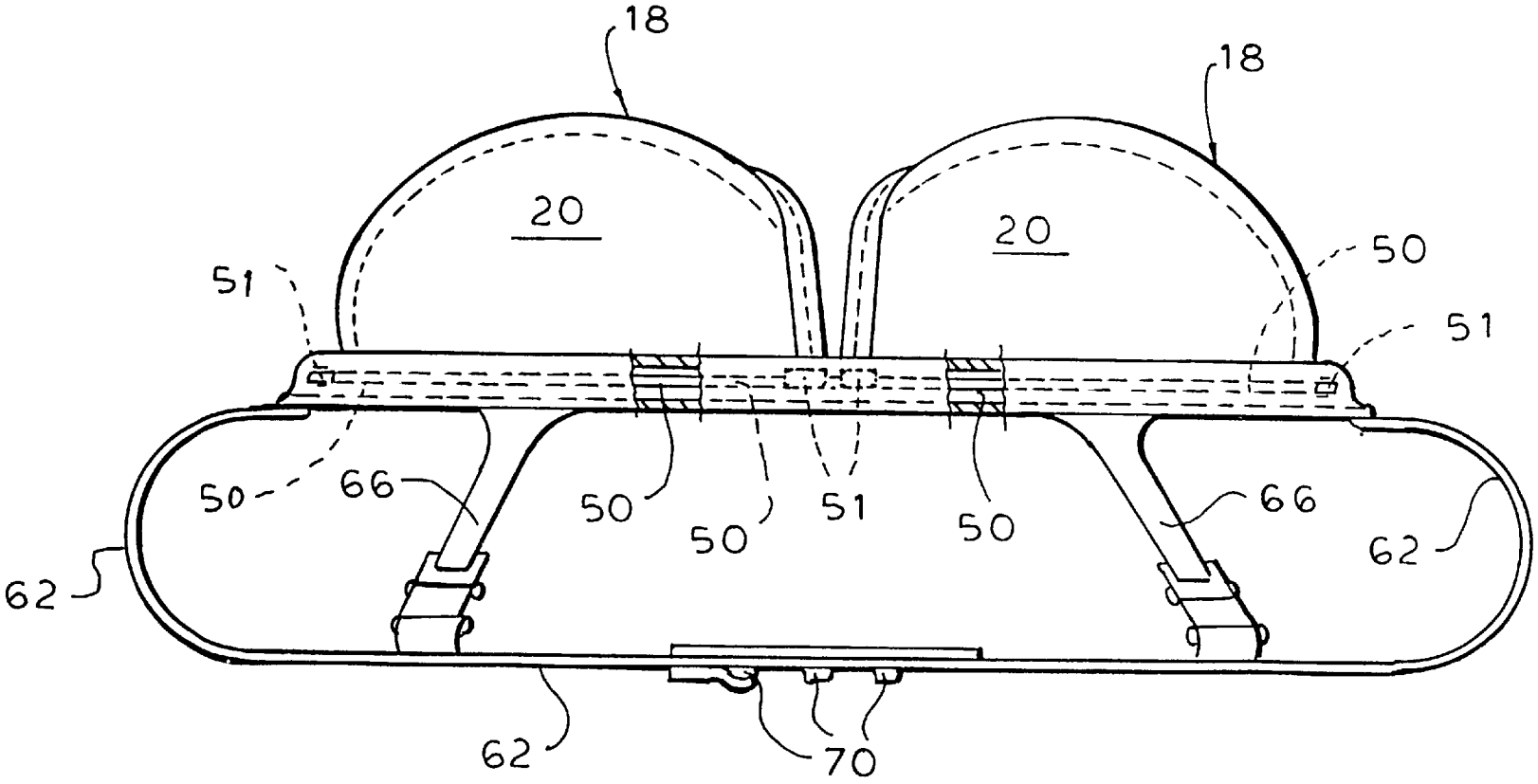
FIG. 7 is a bottom plan view thereof.

For each cup 20, an arcuately curved underwire 50 is disposed in the channel 40 (from the upper outer portion 24 to the lower inner portion 26). The underwire 50 may be made of spring metal, a resilient plastic or a combination thereof. As best seen in FIG. 2, the underwire 50 preferably is thin and substantially flat, with two flat major surfaces configured and dimensioned to lie parallel to the body of the wearer 12—that is, it is preferably of a generally rectangular cross section. The underwire 50 extends substantially the entire length of the underwire-receiving channel 40 (although not into the channel extension 42). Each end or the entire length of a metal underwire 50 may be encased in a cap or sheath 51 made of a softer, smoother material, such as plastic, to minimize damage to the channel 40 during use. The underwire 50 may be secured within its respective channel 40 by conventional means (e.g., stitching). The underwire 50 biases the cup upper outer portion 24 inwardly or medially so that the two underwires 50 cooperatively bias the cup upper outer portions 24 inwardly to provide an inwardly directed push-in cleavage on the upper portions 22, 24 of a wearer's breasts 14. To a lesser degree the underwire 50 further biases the cup lower outer portion 28 inwardly so that the two underwires 50 cooperatively bias the cup lower outer portions 28 inwardly to provide a medially directed push-in cleavage on the lower portions 22, 26 of a wearer's breast 14. The cleavage is produced not by any padding of the bra, but rather by the underwire 50 biasing the two breasts 14 towards each other. Each channel 40—or at least the underwire 50 therein—terminates at a respective cup lower inner portion 26 without appreciable ascent towards the cup upper inner portion 22.

The bra 10 additionally includes conventional support means 60 secured to the front 18 for releasably supporting the front 18 on a female wearer 12 with the breasts 14 of the female wearer substantially within the cups 20. More particularly, support means 60 typically includes a backstrap 62 and, optionally, a pair of shoulder straps 66. Preferably the backstrap 62 extends around the back and sides of the wearer 12 and includes two strap portions and an adjustable and releasable connector—for example, a plurality of hook and eye mechanisms 70—to join the free ends of the two strap portions not secured at a respective cup outer portion 24, 28. The shoulder straps 66 are adjustable in length and connect the cup tops 30 to the backstrap 62.

The bra 10 provides a highly desirable deeply plunging cleavage which extends downwardly all the way to the channel extension 42 so that it can be worn with a wide variety of different clothing styles including decollete styles. The bra 10 avoids the "double breast" appearance of the conventional push-up bra since the bra does not push the breast upwardly to any substantial degree, but rather relies upon a lateral pushing of the breast towards one another to create a cleavage in the center. The bra 10 is lightweight relative to the conventional push-up bra as the underwire 50 is more "L" shaped and less "U" shaped, so that less of the underwire is required. The bra 10 is exceptionally comfortable to wear and this is believed to be a result of the production of a push-in (rather than a push-up) effect to produce cleavage.

To summarize, the present invention provides a lightweight, substantially unpadded, comfortable, push-up underwire bra which provides deeply plunging cleavage while enabling substantially independent motion of the cups (and hence the breasts) relative to one another.

Now that the preferred embodiments of the present invention have been shown and described in detail, various modifications and improvements thereon will be clearly apparent to those skilled in the art. Accordingly, the spirit and scope of the present invention is to be construed broadly and limited only by the appended claims, and not by the foregoing specification.

We claim:

1. A lightweight, substantially unpadded, push-in underwire bra comprising, when worn by a female wearer:

(A) a front including:

(i) a pair of cups, each said cup defining upper inner and outer portions, lower inner and outer portions, a top connecting said upper inner and outer portions and a bottom connecting said lower inner and outer portions; each said cup being configured and dimensioned to hold substantially one breast of a female wearer, each cup defining an underwire-receiving channel extending downwardly from said cup upper outer portion and then inwardly across said cup bottom to said cup lower inner portion where said channel terminates;

(ii) a single underwire-free channel extension connecting said channels of said cups only at said lower inner portions thereof, said cups being connected at said front only by said channel extension, thereby to provide a deeply plunging cleavage and enable substantial independent motion of said cups relative to one another; and (iii) for each said cup, a thin, arcuate underwire disposed in said channel and biasing said cup upper outer portion inwardly, said underwires biasing said cup upper outer portions inwardly to provide push-in cleavage on the wearer's breasts; and (B) means secured to said front for releasably supporting said front on a female wearer with the breasts of the female wearer substantially within said cups.

2. The bra of claim 1 wherein said cups are devoid of substantial padding.

3. The bra of claim 1 wherein, to the extent that said cups contain padding, said padding is uniformly distributed over substantially the entire surface of said cups.

4. The bra of claim 1 wherein said channel extends arcuately downwardly and arcuately inwardly.

5. The bra of claim 1 wherein said channel terminates at said cup lower inner portion without appreciable ascent towards said cup upper inner portion.

6. The bra of claim 1 wherein said channel extension is configured and dimensioned to snugly fit the wearer between and below the breasts.

7. The bra of claim 1 characterized by the absence of a gore connecting said inner portions of said pair of cups above said channel extension.

8. The bra of claim 1 wherein said underwire is substantially flat and has two flat major surfaces configured and dimensioned to lie parallel to the body of the wearer.

9. The bra of claim 1 wherein said underwire extends substantially the entire length of said underwire-receiving channel.

10. The bra of claim 1 wherein said supporting means includes a backstrap secured at each end to a respective outer portion of one of said cups and a pair of shoulder straps connecting said cup tops to said backstrap.

11. The bra of claim 1 wherein each said cup defines an inner lower length extending from said lower inner portion to at least a midpoint between said upper and lower inner portions.

12. The bra of claim 11 wherein said inner lower length is substantially linear.

13. The bra of claim 11 wherein said inner lower lengths of said cups are substantially parallel.

14. A lightweight, substantially unpadded, push-in underwire bra comprising, when worn by a female wearer:

(A) a front including:

(i) a pair of substantially unpadded cups, each said cup defining upper inner and outer portions, lower inner and outer portions, a top connecting said upper inner and outer portions and a bottom connecting said lower inner and outer portions; each said cup being configured and dimensioned to hold substantially one breast of a female wearer, each cup defining an underwire-receiving channel extending arcuately downwardly from said cup upper outer portion and then arcuately inwardly across said cup bottom to said cup lower inner portion where said channel terminates, said channel terminating at said cup lower inner portion without appreciable ascent towards said cup upper inner portion;

(ii) a single underwire-free channel extension connecting said channels of said cups only at said lower inner portions thereof, said channel extension being configured and dimensioned to snugly fit the wearer between and below the breasts, said cups being connected at said front only by said channel extension, thereby to provide a deeply plunging cleavage and enable substantial independent motion of said cups relative to one another; and (iii) for each said cup, a thin, arcuate underwire disposed in said channel and biasing said cup upper outer portion inwardly, said underwire extending substantially the entire length of said underwire-receiving channel, and said underwires biasing said cup upper outer portions inwardly to provide push-in cleavage on the wearer's breasts; and (B) means secured to said front for releasably supporting said front on a female wearer with the breasts of the female wearer substantially within said cups, said supporting means including a backstrap secured at each end to a respective outer portion of one of said cups and a pair of shoulder straps connecting said cup tops to said backstrap.

15. The bra of claim 14 wherein, to the extent that said cups contain padding, said padding is uniformly distributed over substantially the entire surface of said cups.

16. The bra of claim 14 characterized by the absence of a gore connecting said inner portions of said pair of cups above said channel extension.

17. The bra of claim 14 wherein each said cup defines an inner lower length extending from said lower inner portion to at least a midpoint between said upper and lower inner portions, said inner lower length being substantially linear, and said inner lower lengths of said cups being substantially parallel.

* * * * *